US011499271B2

(12) United States Patent
Bergk et al.

(10) Patent No.: US 11,499,271 B2
(45) Date of Patent: Nov. 15, 2022

(54) SWITCH DEVICE

(71) Applicants: VOESTALPINE BWG GMBH, Butzbach (DE); VOESTALPINE VAE GMBH, Vienna (AT)

(72) Inventors: Thomas Bergk, Gotha (DE); Thomas Christ, Erfurt (DE); Jürgen Hellbach, Günthersleben-Wechmar (DE); Torsten Nolte, Erfurt (DE)

(73) Assignees: VOESTALPINE BWG GMBH, Butzbach (DE); VOESTALPINE VAE GMBH, Vienna (AT)

( * ) Notice: Subject to any disclaimer, the term of this patent is extended or adjusted under 35 U.S.C. 154(b) by 420 days.

(21) Appl. No.: 16/621,049

(22) PCT Filed: Aug. 27, 2018

(86) PCT No.: PCT/EP2018/072955
§ 371 (c)(1),
(2) Date: Dec. 10, 2019

(87) PCT Pub. No.: WO2019/057441
PCT Pub. Date: Mar. 28, 2019

(65) Prior Publication Data

US 2020/0208355 A1 Jul. 2, 2020

(30) Foreign Application Priority Data

Sep. 19, 2017 (DE) ..... 10 2017 121 729.0
Dec. 13, 2017 (DE) ..... 10 2017 129 825.8

(51) Int. Cl.
*E01B 7/02* (2006.01)
*E01B 7/24* (2006.01)
*E01B 7/22* (2006.01)

(52) U.S. Cl.
CPC ..... *E01B 7/02* (2013.01); *E01B 7/24* (2013.01); *E01B 7/22* (2013.01);
(Continued)

(58) Field of Classification Search
CPC ..... E01B 7/02; E01B 7/24; E01B 7/22; E01B 2202/027; E01B 2202/042; E01B 2202/046; E01B 7/06
See application file for complete search history.

(56) References Cited

U.S. PATENT DOCUMENTS 4,032,095 A 6/1977 Ferbeck et al.
5,100,046 A 3/1992 Allegrucci et al.
(Continued)

FOREIGN PATENT DOCUMENTS

CN 2418152 Y 2/2001
CN 203547530 U 4/2014
(Continued)

OTHER PUBLICATIONS

Chinese Office Action, dated Feb. 20, 2021, for Chinese Application No. 201880060922.8.
(Continued)

*Primary Examiner* — Mark T Le
(74) *Attorney, Agent, or Firm* — Ladas & Parry LLP; Malcolm J. MacDonald

(57) ABSTRACT

A switch device including a switch rail (12), the switch device having at least one stock rail (14), a junction rail (32) and a switch rail support (16), and the switch rail and the connecting rail being interconnected by a weld joint (34). The switch rail support (16) includes a through-opening (36) or a recess beneath the weld joint, the width of the through-opening or the recess being wider than the width of the switch rail (12). Furthermore, the length of the through-
(Continued)

opening or the recess allows the junction rail (32) to connect to switch rails of the same or different lengths.

11 Claims, 4 Drawing Sheets

(52) U.S. Cl.
CPC ... *E01B 2202/027* (2013.01); *E01B 2202/042* (2013.01); *E01B 2202/046* (2013.01)

(56) References Cited

U.S. PATENT DOCUMENTS

| | | | | | |
|---|---|---|---|---|---|
| 5,170,932 | A * | 12/1992 | Blumauer | B23K 35/004 228/262.41 |
| 2013/0112816 | A1* | 5/2013 | Christ | E01B 7/24 238/17 |

FOREIGN PATENT DOCUMENTS

| | | | | | |
|---|---|---|---|---|---|
| CN | 203795249 | U | | 8/2014 | |
| CN | 104674610 | A | | 6/2015 | |
| CN | 204738187 | U | | 11/2015 | |
| CN | 105735060 | A | | 7/2016 | |
| DE | 685445 | A | | 12/1939 | |
| DE | 685445 | C | | 12/1939 | |
| DE | 853759 | C | | 10/1952 | |
| DE | 1048938 | B | | 1/1959 | |
| DE | 3904026 | A | * | 8/1990 | E01B 7/02 |
| DE | 195 07 376 | A1 | | 9/1996 | |
| DE | 1950376 | C2 | | 1/1998 | |
| DE | 20 2016 002 305 | U1 | | 6/2016 | |
| EP | 0 515 708 | A1 | | 12/1992 | |
| EP | 1020562 | A1 | | 7/2000 | |
| FR | 2 646 115 | A1 | | 10/1990 | |
| TW | M397984 | | | 2/2011 | |

OTHER PUBLICATIONS

Taiwanese Office Action, dated Jul. 22, 2020, corresponding to Taiwanese Application No. 05287/1092069030.

International Search Report dated Oct. 26, 2018, in PCT/EP2018/072955.

* cited by examiner

SWITCH DEVICE

SUMMARY OF THE INVENTION

The invention relates to a switch device, in particular a grooved rail switch device, with a tongue blade, whereby the switch device comprises at least one stock rail, one connecting rail, and one tongue blade support, and whereby the tongue blade and the connecting rail are connected to each other via a weld joint.

BACKGROUND OF THE INVENTION

The invention also relates to a method for replacing a tongue blade in a switch device, in particular a grooved rail switch device, comprising at least one stock rail, one connecting rail as well as one tongue blade support, whereby the tongue blade and the connecting rail are joined to each other by forming a weld joint by welding.

DE 195 07 376 C2 discloses a switch device, in which the tongue blade merges with the connecting rail via a scarf joint. In this, the two rails are connected to each other via mechanical holding elements.

As is described in for example DE 685 445 A or DE 1 048 938 B, tongue blade and connecting rail may also be joined by welding instead of by a mechanical connection.

In a monobloc track switch according to DE 40 11 523 A1, a tongue blade is welded to a connecting rail within a block.

Mechanical connections offer the advantage that tongue blades can be replaced easily. In contrast, welded connections require complex work, in particular if the switch device, which comprises the stock rail, the connecting rail, and the tongue blade support, is produced in monobloc design, i.e. for example has been milled out of a solid block. For this reason, mechanical connections between tongue blade and connecting rail predominantly prevail in switch devices in monobloc design.

It is the objective of the present invention to further develop a switch device and a method for replacing a tongue blade in a switch device in such a manner that a tongue blade can be replaced problem-free even in the case of a welded connection.

To meet this objective, the switch device of the above-mentioned type is characterized in that the tongue blade support on its lower side borders on a hollow space and comprises a through opening connecting to the hollow space below the weld joint, or in that the switch device possesses a cut-out below the weld joint, whereby the width of the through opening or of the cut-out is greater than the width of the tongue blade and the through opening or the cut-out possesses a length that facilitates connecting the connecting rail to tongue blades of equal or different lengths.

A method for replacing a tongue blade is characterized by a switch device, in which the tongue blade support on its underside borders on a hollow space and in the area of the weld joint possesses a through opening into the hollow space, or in which a cut-out is embodied in the tongue blade support below the weld joint, whereby the width of the through opening or the cut-out is greater than the width of the tongue blade and the through opening or the cut-out possesses a length that allows separating cuts between the connecting rail and tongue blades of equal or differing lengths, whereby to replace a tongue blade, a separating cut is performed through the weld joint or a separating cut is performed in the connecting rail adjacent to the weld joint, and subsequently the connecting rail is connected to a new tongue blade, whereby if the separating cut is made at some distance from the previous weld joint, the new tongue blade to be connected to the connecting rail will be longer than the replaced tongue blade by the distance between the previous weld joint and the separating cut.

According to the invention, a switch device consisting of stock rail, connecting rail, and tongue blade support, which also may be referred to as sliding plate, may be deployed embodied as a monobloc design, whereby connecting the tongue blade to the connecting rail by welding does not present a problem, since the cut-out or through opening present in the tongue blade support or sliding plate makes it possible to repeatedly weld a connecting rail or part thereof that form a part of a monobloc to tongue blades, i.e. the replacement of a tongue blade can take place multiple times. This provides the option to use cutting to remove a tongue blade to be removed and to subsequently connect a new tongue blade to the connecting rail by welding. Damage to the switch device itself is ruled out because of the invention's cut-out in the support or the through opening, which facilitates the separating cut and the re-welding. In this, the cut-out or the through opening should be dimensioned relative to the tongue blade or connecting rail in such a manner that weld backings can easily be positioned below the tongue blade or connecting blade, in order to weld a root pass and subsequently to create for example I-seams or V-grooves.

Given properly performed welding, the separating cut can be made in the weld joint. But preferably the cutting will take place at some distance from the weld joint in the connecting rail or in the portion integrated in the monobloc. The new tongue blade subsequently to be welded to the connecting rail is longer than the replaced rail by the amount of the distance between the previous weld joint and the position of the cut. Cutting to size may take place on site.

Preferably it is intended that the length of the cut-out or through opening is 50 mm to 150 mm, in particular 80 mm to 120 mm, and/or the cut-out or the through opening extend on each side of the tongue blade or connecting rail across a width of between 10 mm and 50 mm, in particular between 20 mm and 30 mm. Proper dimensioning in this regard easily allows for example 5 to 6 cuts, i.e. the replacement of 5 to 6 tongue blades, without a loss in functionality of the switch device.

In the absence of a through opening, i.e. if a cut-out is embodied in the support, such as sliding plate, then the depth should be dimensioned so that a weld backing can easily be introduced into the cut-out.

If it is preferably intended that the switch device is embodied in monobloc design, then it is easily possible to employ various other designs that are known in the state of the art. In particular, it is possible to construct the switch device from a lower part and an upper part, whereby in a grooved rail switch device the upper part comprises the stock rail, the connecting rail, the side rail, and the tongue blade support, while the lower part can be a support frame.

Another possible option is a construction in which the switch device consists of an upper part of a steel of high-strength grade and a lower part of construction steel or another low grade steel.

The scope of the invention also encompasses embodying the switch device as one piece from steel of a high-strength grade.

The invention is also characterized in that a switch device is embodied in monobloc fashion, and in particular is arranged on a base plate, some distance from which extends the lower side of the tongue blade support, or in that the switch device comprises a lower part in monobloc design, upon which is arranged an upper part that comprises the tongue blade support.

Preferably the switch device is arranged on a base plate, at some distance from which extends the lower side of the tongue blade support. The hollow space formed in this manner may for example house a heater.

Irrespective thereof, as a further development it is intended that the base plate may possess a drain opening, which if projected along the vertical axis of the switch device preferably at least in sections overlaps the through opening, or that from the cut-out originates a drain opening such as a drain channel or drain hole. This results in particular in the advantage that water entering through the through opening can easily drain.

The invention's method is also characterized in that the switch device is embodied in monobloc design, with a block-like lower part and an upper part comprising a tongue blade support, whereby the cut-out extending below the support should possess a depth that allows inserting a weld backing.

As a further development it is intended that for welding purposes a weld backing is introduced into the through opening or the cut-out.

In particular, the invention is characterized in that the stock rail, a side rail, the connecting rail, and a tongue blade support of the switch device are embodied as a monobloc.

Preferably it is intended that the switch device consists of an upper part and a lower part of equal or different materials.

Further details, advantages and characteristics of the invention are not only found in the claims, the characteristic features explained therein—individually and/or in combination—, but also in the following description of a preferred embodiment example shown in the figures.

DESCRIPTION OF THE PREFERRED EMBODIMENTS

Figure 1:
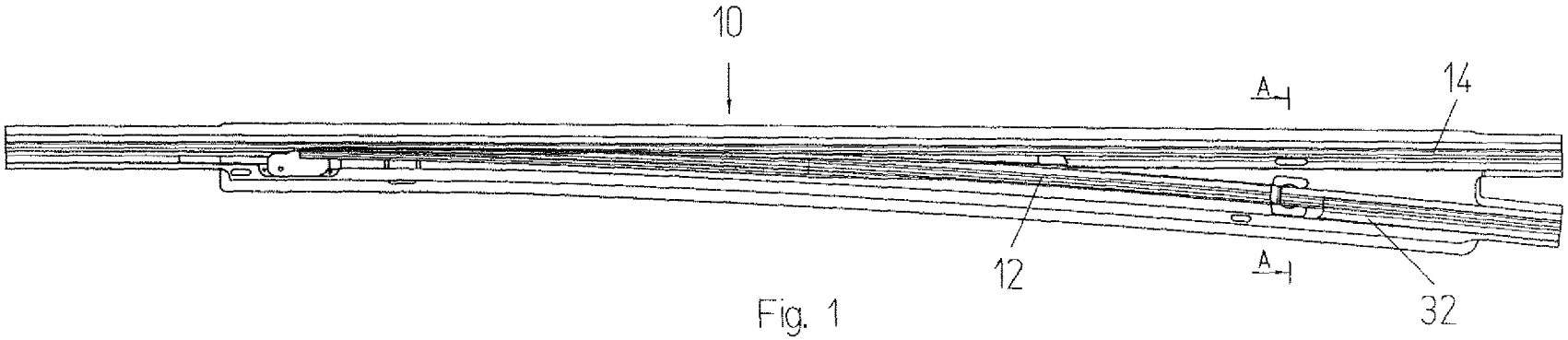
FIG. 1 shows a top view onto a switch device with tongue blade.
Figure 2:
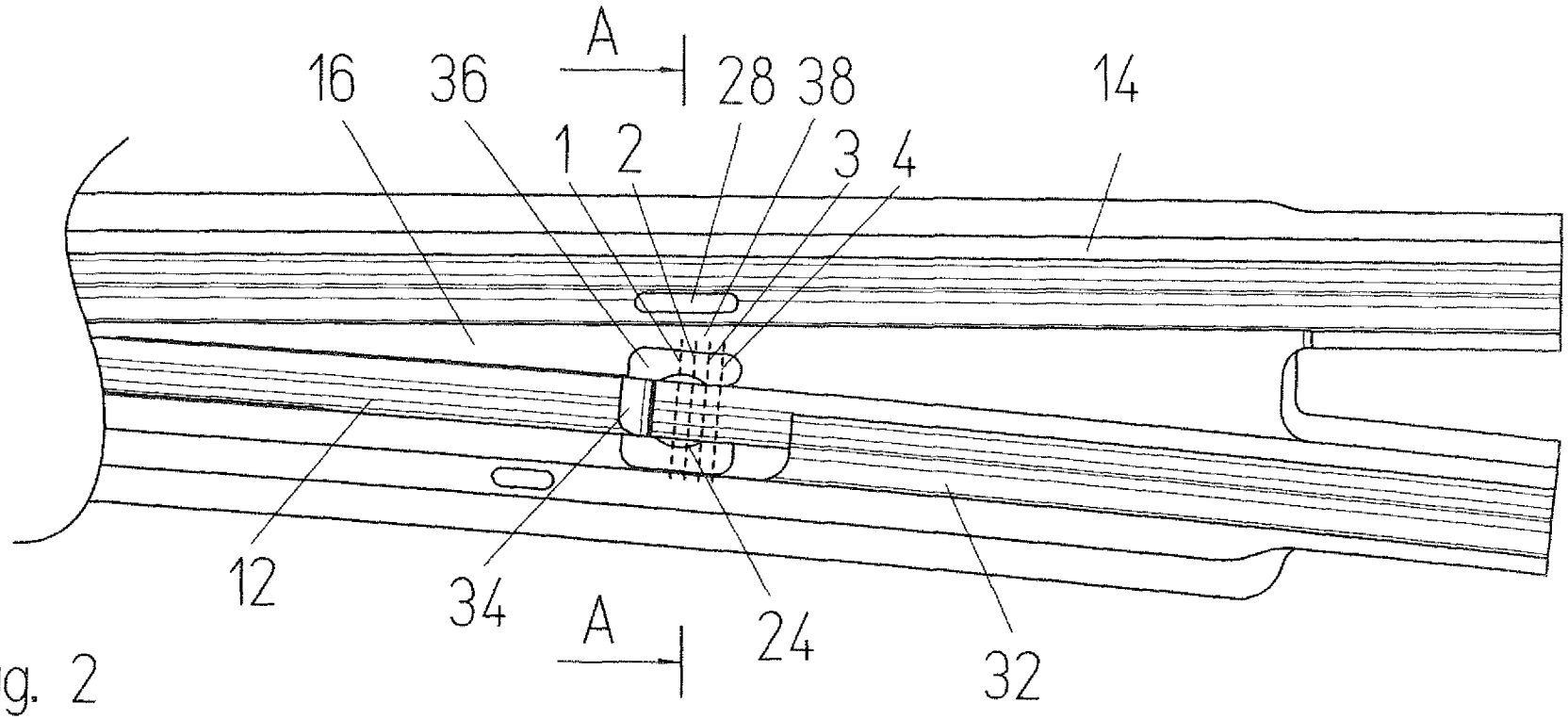
FIG. 2 shows an enlarged portion of FIG. 1.
Figure 3:
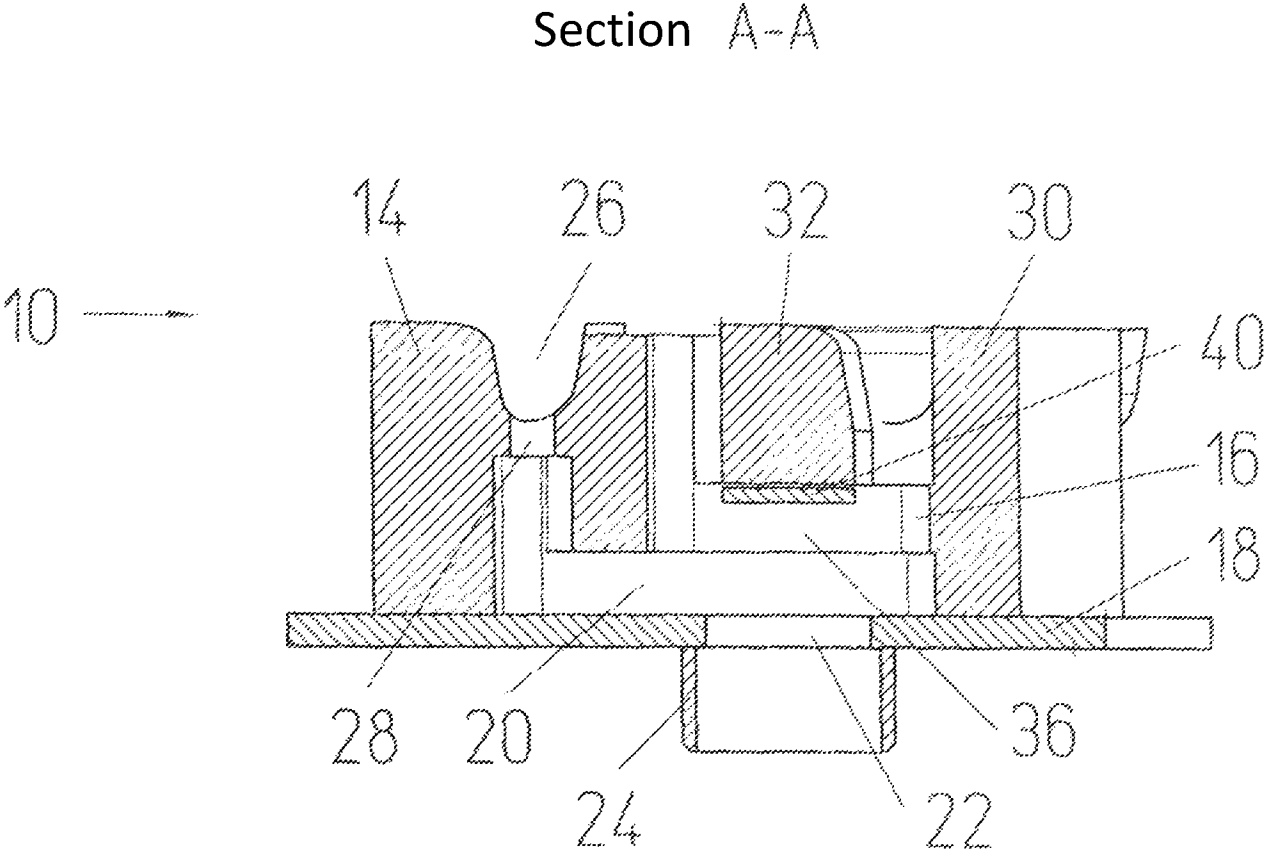
FIG. 3 shows a sectional view along the line A-A in FIG. 1 and FIG. 2.

FIGS. 1-3 show a switch device 10 embodied in monobloc construction, without this affecting the scope of the invention's teachings. Rather, the switch device 10, which accepts a tongue blade 12, can also consist of several individual parts. However, a monobloc design is preferred.

The switch device 10, which is explained using a grooved rail switch device as well, comprises in the known manner a stock rail 14, a side rail 30, as well as a sliding plate 16, which also may be referred to as tongue blade support. The tongue blade 12 is arranged adjustable in the known manner on the sliding plate 16. The stock rail 14 with the sliding plate 16 are sections of the switch device 10, which as was shown before in the drawings is embodied as a monobloc.

The switch device 10 of the embodiment example is arranged on a base plate 18, which in dependence on the overall height of the standard rails or grooved rail profiles, such as R59/60, possesses suitably adjusted thicknesses, so that no height adjustment of the switch device 10 itself is required.

The slide plate 16 extends at some distance from the surface of the base plate 18, as is indicated in the sectional view of FIG. 3. The hollow space 20 formed thusly may for example contain a heater. The hollow space 20 also serves as a drain, which via an opening 22 in the base plate merges into a drain plug 24. Furthermore, provided in the groove 26 of the stock rail 14 are drain openings 28, which are connected to the hollow space 20.

The slide plate 16 extends between the stock rail and the side rail 30, which extends along the longitudinal direction of the switch device 10 and which is part of the monobloc.

The switch device 32 further comprises a connecting rail 32, which is connected to the tongue blade 12 by welding. The corresponding weld joint is identified by the reference label 34. In the embodiment example of FIG. 3, this weld joint is situated above a through opening 36, which preferably is situated directly above the drain plug 24, which means that the projection of the through opening 36 along the vertical axis of the switch device overlaps the drain plug 24, which is clarified in particular in FIG. 2.

If the tongue blade 12 is for example worn or has been damaged, it must be replaced. For this, one performs a separating cut directly in the joint plane or at some distance to the latter, as is indicated by the lines 1, 2, 3, 4. These are separating cuts 38, which can be performed easily, in particular because of the provided through opening 36. Both the separating cutting and welding-in a new tongue blade is easily performed. For this, it is in particular intended that a plate-shaped weld pool backing, such as sheet metal, is positioned below the connecting rail 32 and the tongue blade in the joint region, in order to be able to easily weld a root pass and subsequently to form for example I-seams or V-grooves. Compared to the tongue blade to be replaced, the newly to be inserted tongue blade is longer by an amount that corresponds to the distance between the weld joint 34 of the to-be-replaced tongue blade and the separating cut. If this separating cut is performed directly in the weld joint 34, then the new tongue blade has the same length as the replaced one.

Consequently, the free space created by the through opening 36 facilitates a problem-free e.g. autogenous cutting and welding on account of the clearance available for the cutting jet. Other methods for are also feasible for performing the separating cut.

To weld in a new tongue blade, the weld backing 40 is introduced into the through opening below the rail foot. The weld backing may consist of sheet metal and possesses a width that should correspond to at least the width of the tongue width.

The through opening described with the help of FIG. 3 represents a preferred embodiment of the invention's teachings. As an alternative, which is illustrated in FIG. 4, which uses the same reference labels as in FIG. 3 for identical elements, it is possible to create a cut-out 116 in the tongue blade support, i.e. in the sliding plate 16, namely in the area of the to be created weld connection, into which can be introduced a weld backing 40 in accordance with FIG. 3.

Figure 4:
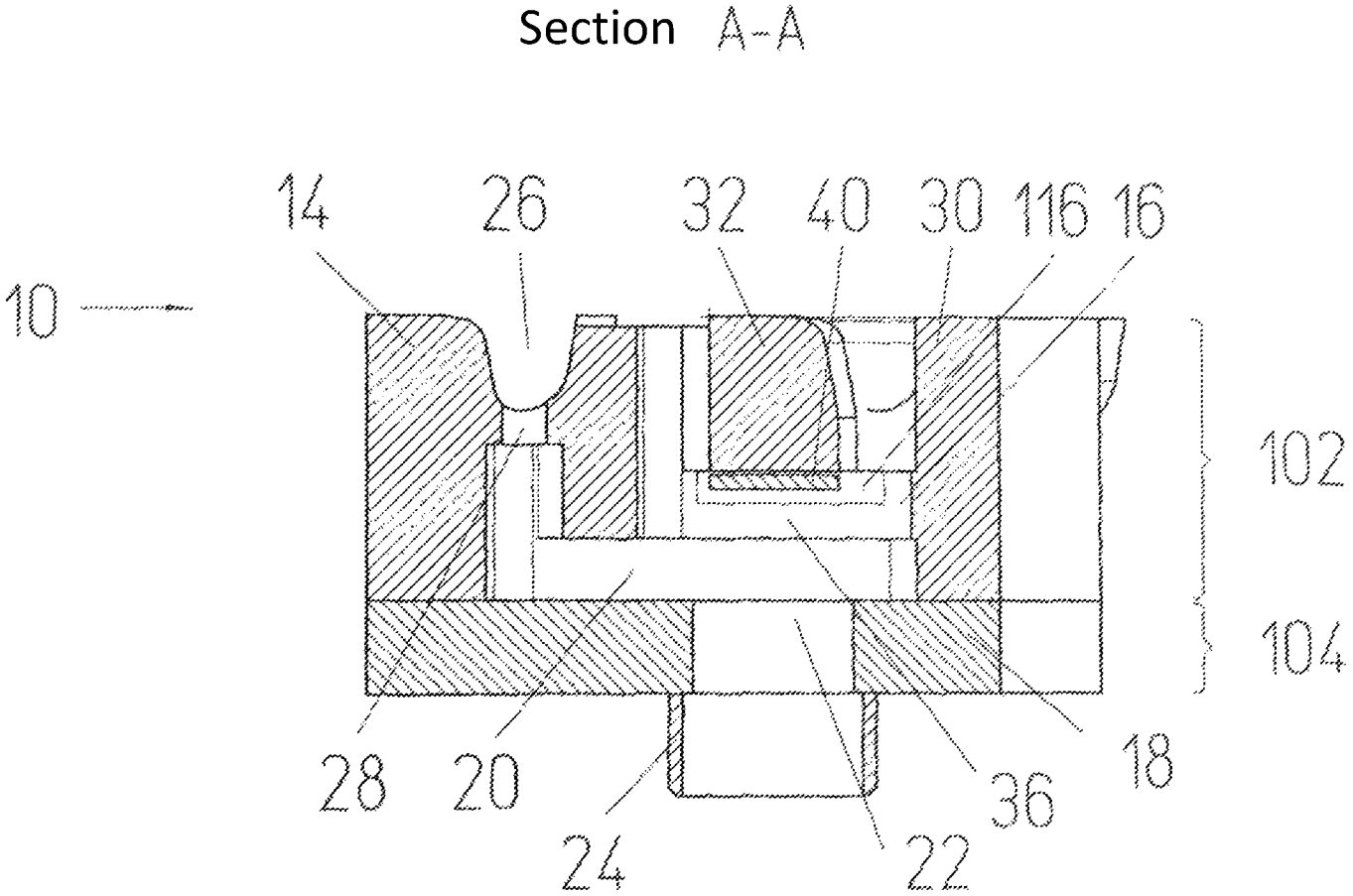
FIG. 4 shows a sectional view according to FIG. 3, through an alternative switch device.

The sectional view of FIG. 4 shows a switch device 100 that has been manufactured in monobloc construction, however not as a single level, but consists of an upper part 102 and a lower part 104. The upper part 102 consists of high-strength steel, whereas the lower part may for example consist of structural steel. In accordance with the embodiment of FIG. 3, a drainage hole 28, which may merge with the connecting sleeve 24, may originate from the lowest point of the groove 26 of the stock rail 14, without this being an obligatory feature. It is also possible for the switch device 100 to be arranged on a base plate 18 of a desired thickness, as has been explained in connection with FIG. 3.

The invention relates to a switch device with tongue blade 12, whereby the switch device comprises at least one stock rail 14, one connecting rail 32, and one tongue blade support 16, and the tongue blade and the connecting rail are connected to each other via a weld joint 34. Below the weld joint, the tongue blade support 16 comprises a through opening 36 or cut-out 116, whereby the width of the through opening 36 or the cut-out 116 is greater than the width of the tongue blade 12. Further, the through opening 36 or the cut-out 116 possess a length that facilitates connecting the connecting rail 32 to tongue blades of equal or different lengths.

The invention claimed is:

1. A switch device comprising:

a tongue blade, a stock rail, a connecting rail, and a tongue blade support, wherein the tongue blade and the connecting rail are connected to each other via a weld joint, wherein a lower side of the tongue blade support borders on a hollow space, and below the weld joint comprises a through opening passing into the hollow space, or wherein the switch device possesses a cut-out below the weld joint in the tongue blade support, wherein the width of the through opening or cut-out is greater than the width of the tongue blade, and the through opening or the cut-out possesses a length that facilitates joining the connecting rail with tongue blades of equal or different lengths.

2. The switch device of claim 1, wherein the switch device is embodied in monobloc design and is arranged on a base plate, at some distance from which extends the lower side of the tongue blade support, or wherein the switch device comprises a lower part embodied in monobloc design, on which is arranged an upper part that comprises the tongue blade support.

3. The switch device of claim 2, wherein the base plate comprises a drain opening, which, if projected along the vertical axis of the switch device, at least sectionally overlaps with the through opening, or wherein a drain opening, a drain channel, or a drain hole originates from the cut-out.

4. The switch device of claim 1, wherein the length of the through opening or cut-out is 50 mm to 150 mm, and/or the through opening or the cut-out extends on each side of the tongue blade or connecting rail over a width of between 10 mm and 50 mm.

5. A method for replacing a tongue blade in a switch device having at least one stock rail, a connecting rail, and a tongue blade support, wherein the tongue blade and the connecting rail are connected to each other by forming a weld joint by means of welding, the method comprising:

providing a switch device wherein a lower side of the tongue blade support is bordered by a hollow space, and in the area of the weld joint comprises a through opening that passes into the hollow space, or wherein a cut-out is embodied below the weld joint in the tongue blade support, wherein the width of the through opening or cut-out is greater than the width of the tongue blade and the through opening or cut-out possesses a length that allows separating cuts between the connecting rail and tongue blades of equal or different lengths, making a separating cut through the weld joint, or making a separating cut adjacent to the weld joint in the connecting rail, removing the tongue blade, and then welding the connecting rail to a new tongue blade, wherein, when the separating cut extends at a distance from the previous weld joint, the new tongue blade to be connected to the connecting rail will be longer than the replaced tongue blade by the distance between the previous joint weld and the separating cut.

6. The method of claim 5, wherein the switch device is arranged on a base plate, which possesses a height that is adapted to an overall height of a standard rail, or as grooved rail sections to be connected to the switch device.

7. The method of claim 5, wherein the switch device is embodied in monobloc design with a lower part and an upper part, the lower part having a block construction, and the upper part comprising the tongue blade support, whereby the cut-out extending below the weld joint possesses a depth that is sufficient to allow an insertion of a weld backing.

8. The method of claim 5, wherein, for welding purposes, a weld backing is introduced into the through opening or the cut-out.

9. The method of claim 5, wherein the stock rail, a side rail, the connecting rail, and the tongue blade support of the switch device are embodied as a monobloc.

10. The method of claim 5, wherein the switch device consists of an upper part and a lower part of equal or different materials.

11. The switch device of claim 1, wherein the length of the through opening or cut-out is 80 mm to 120 mm, and/or the through opening or the cut-out extends on each side of the tongue blade or connecting rail over a width of between 20 mm and 30 mm.

* * * * *